US009435075B2

(12) United States Patent
Ohashi et al.

(10) Patent No.: US 9,435,075 B2
(45) **Date of Patent: *Sep. 6, 2016**

(54) INK FOR INK JET TEXTILE PRINTING, INK JET TEXTILE PRINTING METHOD, AND INK JET TEXTILE PRINTING APPARATUS

(71) Applicant: Seiko Epson Corporation, Tokyo (JP)

(72) Inventors: Masakazu Ohashi, Shiojiri (JP); Toru Saito, Yamagata-mura (JP); Tomoki Shinoda, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 178 days.

This patent is subject to a terminal disclaimer.

(21) Appl. No.: 14/163,557

(22) Filed: Jan. 24, 2014

(65) Prior Publication Data

US 2014/0210901 A1 Jul. 31, 2014

(30) Foreign Application Priority Data

Jan. 31, 2013 (JP) ..... 2013-016569

(51) Int. Cl.

| | |
|---|---|
| ***B41J 2/21*** | (2006.01) |
| ***D06P 5/30*** | (2006.01) |
| ***B41J 2/175*** | (2006.01) |
| ***D06P 5/00*** | (2006.01) |
| ***D06P 1/92*** | (2006.01) |
| *D06P 1/52* | (2006.01) |
| *D06P 1/90* | (2006.01) |

(52) U.S. Cl.

CPC ..... *D06P 5/30* (2013.01); *B41J 2/17523* (2013.01); *B41J 2/2107* (2013.01); *D06P 1/928* (2013.01); *D06P 5/002* (2013.01); *D06P 1/5257* (2013.01); *D06P 1/5285* (2013.01); *D06P 2001/906* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 11/002; B41J 2/2056; B41J 2/21; B41J 2/0057; B41J 3/60; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218

USPC ..... 347/95–105

See application file for complete search history.

(56) References Cited

U.S. PATENT DOCUMENTS

| | | | | |
|---|---|---|---|---|
| 4,380,770 | A * | 4/1983 | Maruyama | B41J 2/16508 347/92 |
| 6,294,592 | B1 * | 9/2001 | Herrmann | B41M 5/0023 106/31.6 |
| 2006/0017787 | A1 * | 1/2006 | Inoue | B41J 2/17513 347/85 |
| 2010/0091052 | A1 | 4/2010 | Ogawa et al. | |
| 2010/0091502 | A1 | 4/2010 | Warner et al. | |

FOREIGN PATENT DOCUMENTS

| | | | |
|---|---|---|---|
| JP | 4214734 | B2 | 1/2009 |
| JP | 2009-030014 | A | 2/2009 |
| JP | 2011-174007 | A | 9/2011 |

* cited by examiner

*Primary Examiner* — Manish S Shah

(74) *Attorney, Agent, or Firm* — Nutter McClennen & Fish LLP; John J. Penny, Jr.; Santiago Velez

(57) ABSTRACT

An ink for ink jet textile printing according to the invention which is used for recording on cloth includes a pigment, a resin, and a 2-pyrrolidone-based solvent, in which the pH is in the range of 9.2 to 10.5. Coating elongation of the resin may be in the range of 400% to 1200%, and the resin may be a urethane-based resin.

22 Claims, 4 Drawing Sheets

INK FOR INK JET TEXTILE PRINTING, INK JET TEXTILE PRINTING METHOD, AND INK JET TEXTILE PRINTING APPARATUS

BACKGROUND

1. Technical Field

The present invention relates to an ink for ink jet textile printing, an ink jet textile printing method, and an ink jet textile printing apparatus.

2. Related Art

In the related art, a textile printing method of recording an image on cloth such as fabrics, knitting, and non-woven fabrics is known. As the textile printing method, a screen textile printing method is widely used, and the use of an ink jet recording method is recently examined in terms of using an ink used for textile printing efficiently or the like. Specifically, in the textile printing method using the ink jet recording method (hereinafter, also referred to as an "ink jet textile printing method"), an image is formed on cloth by discharging an ink in a state of droplets from a nozzle of a head to be attached to the cloth.

The ink used for the ink jet textile printing method is formed of, for example, coloring matters such as a pigment or a dye, dispersants (surfactants), and solvents (water, an organic solvent, and the like). Specifically, JP-A-2011-174007 discloses an ink for ink jet textile printing containing water, a water-soluble solvent, dispersants such as polyoxyethylene alkyl ether, disperse dyes, acetylenediol, and acetylene glycol.

However, when a dye is used as a coloring matter, since properties such as light resistance of an image to be recorded are not likely to be excellent, a pigment is used instead of a dye in some cases. For example, an ink for ink jet textile printing which contains a color pigment, a resin, an organic solvent, and an aqueous medium is disclosed in Japanese Patent No. 4214734 and JP-A-2009-30014.

As disclosed in Japanese Patent No. 4214734 and JP-A-2009-30014, when a pigment is used as a coloring matter, a fixing resin is necessary to be added to an ink in order for the pigment to be fixed on cloth. Particularly, the cloth in which an image is recorded (printed) with the ink jet textile printing method is used for clothes or bedclothes which need to be washed frequently in many cases. Accordingly, it is necessary to increase the amount of a resin in an ink for improving fixation (friction resistance) of an image recorded on cloth.

However, in the ink for ink jet textile printing using a pigment as a coloring matter as disclosed in Japanese Patent No. 4214734 and JP-A-2009-30014, aggregates due to a resin are generated in some cases. Especially, the aggregates tend to be significantly generated at a place (that is, a gas-liquid interface) in which an ink supplied to an ink jet textile printing apparatus is in contact with air (bubble) mixed in the ink jet textile printing apparatus.

Particularly, the cloth on which an image is recorded (printed) with the ink jet textile printing method is used for clothes or bedclothes which need to be washed frequently in many cases. Accordingly, it is necessary to increase the amount of a resin in an ink for improving fixation (friction resistance) of an image recorded on the cloth. By doing this, the aggregates due to the resin may be generated more frequently.

In addition, since the cloth on which an image is printed by the textile printing has a property of being easily contracted or expanded, a soft resin with a low glass transition temperature is added to an ink in order for the recorded image to follow the cloth in some cases. Since such a resin easily forms a film, aggregates due to the resin may be generated more frequently.

When such aggregates are generated, the discharging stability of the ink becomes degraded due to the aggregates in some cases.

Further, at the time of storing the ink for ink jet textile printing or filling the ink for ink jet textile printing in the ink jet textile printing apparatus, the viscosity of the ink or the particle size of the pigment is temporarily changed and the storage stability of the ink is degraded in some cases. When the ink jet textile printing is performed using the ink of which the storage stability is degraded, the discharging stability of the ink becomes degraded in some cases.

SUMMARY

An advantage of some aspects of the invention is to provide an ink for ink jet textile printing capable of suppressing the generation of aggregates and having an excellent storage stability, an ink jet textile printing apparatus, and an ink jet textile printing method.

The invention can be implemented as the following aspects or application examples.

Application Example 1

According to this application example, there is provided an ink for ink jet textile printing which is used for recording on cloth including a pigment, a resin, and a 2-pyrrolidone-based solvent, in which the pH is in the range of 9.2 to 10.5.

Application Example 2

In the ink for ink jet textile printing according to Application Example 1, coating elongation of the resin is in the range of 400% to 1200%.

Application Example 3

In the ink for ink jet textile printing according to Application Example 1 or 2, the resin contains at least one kind selected from a urethane-based resin and an acrylic resin.

Application Example 4

In the ink for ink jet textile printing according to any one of Application Examples 1 to 3, the resin is a self-emulsifying dispersion.

Application Example 5

In the ink for ink jet textile printing according to any one of Application Examples 1 to 4, the content of the 2-pyrrolidone-based solvent is in the range of 1% by mass to 8% by mass.

Application Example 6

In the ink for ink jet textile printing according to any one of Application Examples 1 to 5, the ink for ink jet textile printing includes an inorganic base.

Application Example 7

According to this application example, there is provided a textile printing method using the ink for ink jet textile printing according to any one of Application Examples 1 to 6, including forming an image by attaching liquid droplets of the ink to an area of the cloth to which a coagulant which reacts with a component contained in the ink is applied.

Application Example 8

According to this application example, there is provided an ink jet textile printing apparatus including: a head which includes a supply channel through which the ink for ink jet textile printing according to any one of Application Examples 1 to 6 flows and a nozzle which is connected to the supply channel and discharges the ink; and at least one of a valve unit which is connected to the head and restricts the flow of the ink to be supplied to the head and a filter unit which is provided in the supply channel of the head.

Application Example 9

In the ink jet textile printing apparatus according to Application Example 8, the ink supplied to the valve unit is in contact with air.

Application Example 10

In the ink jet textile printing apparatus according to Application Example 8 or 9, the ink supplied to the filter unit is in contact with air.

Application Example 11

In the ink jet textile printing apparatus according to any one of Application Examples 8 to 10, the valve unit includes a pressure chamber and an introduction chamber, the introduction chamber stores the ink to be supplied to the pressure chamber, the pressure chamber includes a connection portion which is connected to the introduction chamber through a pressure adjusting valve restricting the outflow of the ink from the introduction chamber and a connection portion which is connected to the supply channel of the head, and the volume of the pressure chamber is in the range of 400 $mm^3$ to 5000 $mm^3$.

Application Example 12

In the ink jet textile printing apparatus according to any one of Application Examples 8 to 11, the filter unit includes a filter member, and the area of the filter member is in the range of 7 $mm^2$ to 120 $mm^2$.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
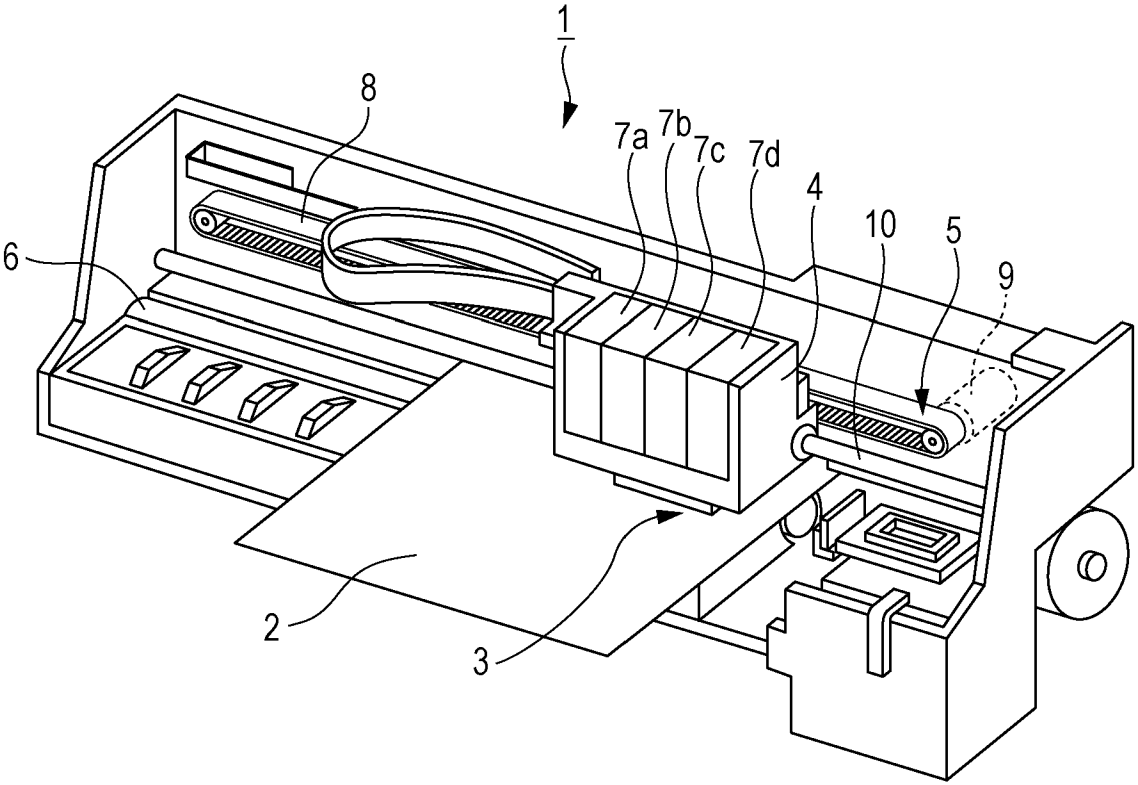
FIG. 1 is a perspective view schematically illustrating an ink jet textile printing apparatus according to the present embodiment.

Hereinafter, the preferred embodiments of the invention will be described. The embodiments described below merely describe an example of the invention. Further, the invention is not limited to the following embodiments and includes various modifications performed within the range without departing from the scope of the invention.

1. Ink for Ink Jet Textile Printing

An ink for ink jet textile printing according to an embodiment of the invention, which is used for recording on cloth, includes a pigment, a resin, and a 2-pyrrolidone-based solvent, in which the pH is in the range of 9.2 to 10.5.

Examples of the cloth, which are not particularly limited to the following, include fabrics, knitting, and non-woven fabrics using natural fibers such as silk, cotton and wool; and synthetic fibers such as nylon, polyester, polypropylene, and rayon as raw materials.

Hereinafter, the components contained in the ink for ink jet textile printing (hereinafter, also simply referred to as an "ink") according to the present embodiment will be specifically described.

1.1. Pigment

The ink according to the present embodiment contains a pigment. As the pigment, both an organic pigment and an inorganic pigment can be used and any color of pigment can be used.

As the white-based pigment, which is not limited to the following, for example, a white inorganic pigment such as titanium oxide, zinc oxide, zinc sulfide, antimony oxide, or zirconium oxide can be exemplified. A white organic pigment such as a white hollow resin particle or a polymer particle can be used instead of the white inorganic pigment.

As the color index (C.I.) of the white-based pigment, which is not limited to the following, for example, C.I. Pigment White 1 (basic lead carbonate), 4 (zinc oxide), (a mixture of zinc sulfide and barium sulfate), 6 (titanium oxide), 6:1 (titanium oxide containing other metal oxides), 7 (zinc sulfide), 18 (calcium carbonate), 19 (clay), (mica titanium), 21 (barium sulfate), 22 (natural barium sulfate), 23 (gloss white), 24 (alumina white), 25 (plaster), 26 (magnesium oxide and silicon oxide), 27 (silica), or 28 (anhydrous calcium silicate) is exemplified. Among these, titanium oxide is preferable because titanium oxide is excellent in coloring property, concealing property, and visibility (brightness) and excellent dispersion particle size can be obtained.

Among the above-described titanium oxide, general rutile type titanium oxide is preferable as the white-based pigment. As the rutile type titanium oxide, self-produced titanium oxide or commercially available titanium oxide may be used. As an industrial production method in the case in which the rutile type titanium oxide (powdery) is self-produced, known methods such as a sulfate method and a chlorine method in the related art can be exemplified. Examples of the commercially available products of the rutile type titanium oxide may include rutile types such as Tipaque (registered trade mark) CR-60-2, CR-67, R-980, R-780, R-850, R-980, R-630, R-670, and PF-736 (all trade names, manufactured by Ishihara Sangyo Kaisha, Ltd.).

In addition, the ink according to the present embodiment may include a pigment other than the white-based pigments. A pigment other than the white-based pigments means a pigment in which the above-described white-based pigments are excluded. As the pigment other than the white-based pigments, which is not limited to the following, for example, an azo-based, phthalocyanine-based, dye-based, condensed polycyclic, nitro-based, or nitroso-based organic pigment (brilliant carmine 6B, lake red C, watching red, disazo yellow, hansa yellow, phthalocyanine blue, phthalocyanine green, alkali blue, aniline black, or the like); metals such as cobalt, iron, chrome, copper, zinc lead, titanium, vanadium, manganese, and nickel; metal oxides; sulfide; carbon blacks such as furnace carbon black, lamp black, acetylene black, and channel black (C.I. Pigment black 7); and an inorganic pigment such as yellow ocher, ultramarine, or navy can be used.

More specifically, examples of the carbon black which can be used as a black-based pigment include MCF88, No. 2300, 2200B, 900, 33, 40, 45, 52, MA7, 8, and 100 (all trade names, manufactured by Mitsubishi Chemical Corporation); Raven 5750, 5250, 5000, 3500, 1255, and 700 (all trade names, manufactured by Columbia Carbon Company); Regal 400R, 330R, 660R, Mogul L, Monarch 700, 800, 880, 900, 1000, 1100, 1300, and 1400 (all trade names, manufactured by Cabot Corporation); Color Black FW1, FW2, FW2V, FW18, FW200, 5150, S160, 5170, Printex 35, U, V, 140U, Special Black 6, 5, 4A, and 4 (all trade names, manufactured by Degussa Corp.).

Examples of the yellow-based pigments include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of the magenta-based pigment include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, C.I. Pigment Violet 19, 23, 32, 33, 36, 38, 43, and 50.

Examples of the cyan-based pigment include C.I. Pigment Blue 1, 2, 3, 15, 15:1, 15:2, 15:3, 15:34, 15:4, 16, 18, 22, 25, 60, 65, and 66.

Examples of the pigment other than magenta, cyan, and yellow include C.I. Pigment Green 7, 10, C.I. Pigment Brown 3, 5, 25, 26, C.I. Pigment Orange 1, 2, 5, 7, 13, 14, 15, 16, 24, 34, 36, 38, 40, 43, and 63.

The pigments described above may be used alone or in combination of two or more kinds thereof.

The content of the pigment contained in the ink according to the present embodiment is preferably in the range of 1% by mass to 30% by mass, more preferably in the range of 1% by mass to 15% by mass, and still more preferably in the range of 5% by mass to 13% by mass based on the total mass of the ink from the viewpoint of securing excellent coloring properties of the pigments, which are different from one another depending on the kind of pigment being used.

The pigment may be a pigment to which a surface treatment is applied or a pigment using a dispersant or the like from the viewpoint of improving dispersibility in the ink.

The pigment to which a surface treatment is applied is a pigment in which a hydrophilic group (a carboxyl group, a sulfonic acid group, or the like) is allowed to be dispersed in an aqueous solvent by being directly or indirectly bound on the surface of the pigment with a physical treatment or a chemical treatment (hereinafter, also referred to as a "self-dispersing type pigment").

In addition, the pigment using a dispersant is a pigment which is allowed to be dispersed by a surfactant or a resin (hereinafter, also referred to as a "polymer-dispersing type pigment"), and it is possible to use a known substance as a surfactant or a resin. Further, among the "polymer-dispersing type pigments", a pigment coated with a resin is also included. The pigment coated with a resin can be obtained using an acid deposition method, a phase inversion emulsification method, and a mini-emulsion polymerization method.

1.2. Resin

The ink according to the present embodiment contains a resin. Since the adhesion between the ink and the cloth can be improved by containing a resin, the friction resistance of the image to be recorded can be improved.

The ink according to the present embodiment can be preferably used for recording on the cloth. Here, it is preferable that the image being recorded (that is, an ink film being formed by the ink) be easily expanded or contracted (easily elongated) because the cloth which is easily expanded or contracted. That is, it is possible to prevent the ink film from being damaged or cracked and to secure washing and friction fastness by having an elongation in which the ink film can be expanded or contracted corresponding to the expansion or contraction of the cloth. From this viewpoint, the coating elongation of the resin contained in the ink according to the present embodiment is preferably in the range of 400% to 1200%, more preferably in the range of 500% to 1200%, still more preferably in the range of 600% to 1200%, and particularly preferably in the range of 700% to 1200%. When the coating elongation of the resin is within the above-described range and is especially not lower than the lower limit, an image with an excellent following property with respect to the expansion or contraction of the cloth can be formed. Further, when the coating elongation of the resin is within the above-described range and is especially not higher than the upper limit, the viscosity of the ink film can be maintained in an appropriate range and degradation of an anchoring effect on the cloth can be suppressed, and therefore an image with excellent washing and friction fastness (friction resistance) can be formed while the degradation of fixation is suppressed.

The coating elongation of the resin is measured as follows. Firstly, the resin is coated on a polytetrafluoroethylene sheet such that the film thickness after drying becomes 500 μm, dried at normal temperature (20° C.) and at normal pressure (65% RH) for 15 hours, and further dried at 80° C. for 6 hours and at 120° C. for 20 minutes, and then is peeled off from the sheet to form a resin film. Further, the coating elongation of the obtained resin film is measured using a tension tester at a measurement temperature of 20° C. and measurement speed of 200 mm/min. The measurement of the coating elongation is performed by elongating the resin film and measuring the length of the coating film elongated before being damaged, and the ratio thereof is represented as the coating elongation as a percentage. In addition, as the tension tester, for example, a tensilon universal tester RTC-1225A (trade name, Orientec Co., Ltd.) or a tester equivalent to the tensilon universal tester can be used.

Further, in the resin contained in the ink, a glass transition point (Tg) thereof is preferably 0° C. or less and more preferably −10° C. or less from the viewpoint that it is possible to prevent the ink film from being damaged or cracked and to secure washing and friction fastness. In addition, the lower limit of the glass transition point (Tg) is preferably −80° C. or higher. Further, in the resin contained in the first ink, the minimum film formation temperature (MFT) thereof is preferably 0° C. or less and more preferably −10° C. or lower from the viewpoint that it is possible to prevent the ink film from being damaged or cracked and to secure washing and friction fastness. Furthermore, the lower limit of the minimum film formation temperature is preferably −80° C. or higher.

It is preferable that the resin be emulsion from the viewpoint that the friction resistance and fixation of the coating, and storage stability of the ink can be improved. The resin contained in the ink according to the present embodiment may be a self-emulsifying resin in which a hydrophilic component necessary for being stably dispersed in water is introduced or a resin which becomes water dispersible by the use of an external emulsifier, but the resin is preferably a self-emulsifying dispersion (self-emulsifying emulsion) having no emulsifier from the viewpoint that the reaction of a polyvalent metal compound included in a pretreatment agent described below with the ink is difficult to be hindered.

As the resin, for example, an acrylic resin, a styrene acrylic resin, a fluorene-based resin, a urethane-based resin, a polyolefin-based resin, a rosin-modified resin, a terpene-based resin, a polyester-based resin, a polyamide-based resin, an epoxy-based resin, a vinyl chloride-based resin, a vinyl chloride-vinyl acetate copolymer, or an ethylene vinyl acetate-based resin can be used. These resins may be used alone or in combination of two or more kinds thereof. Among these, since flexibility of design is high and a desired coating physical property (the above-described coating elongation) can be easily obtained, it is preferable to use at least one kind selected from a urethane-based resin and an acrylic resin and more preferable to use a urethane-based resin.

As the urethane-based resin, which is not particularly limited as long as a resin has a urethane skeleton and is water dispersible, for example, commercially available products such as Superflex 460, 460s, and 840 (trade names, manufactured by Dai-ichi Kogyo Seiyaku Co., Ltd.), Resamine D-1060, D-2020, D-4080, D-4200, D-6300, and D-6455 (trade names, manufactured by Dainichiseika Color & Chemicals Mfg. Co., Ltd), Takelac WS-6021 and W-512-A-6 (trade names, manufactured by Mitsui Chemicals Polyurethane, Inc.), and Suncure 2710 (trade name, manufactured by Lubrizol Corp) may be used.

In addition, as the urethane-based resin, an anionic urethane-based resin having an anionic functional group such as a carboxy group, a sulfo group, or a hydroxyl group is preferable from the viewpoint of storage stability of the ink and improving reactivity with a polyvalent metal compound when the polyvalent metal compound is contained in a pretreatment agent described below. Among the above-described commercially available products, examples of the anionic urethane resin include Superflex 460, 460s, or 840 manufactured by Dai-ichi Kogyo Seiyaku Co., Ltd., and Takelac WS-6021, or W-512-A-6 manufactured by Mitsui Chemicals Polyurethane, Inc.

Further, as the urethane resin, a polyether type urethane resin containing an ether bond in a main chain, a polyester type urethane resin containing an ester bond in the main chain, or a polycarbonate type urethane resin containing a carbonate bond in the main chain can be used in addition to a urethane bond. These urethane resins may be used in combination of plural kinds thereof.

As the acrylic resin, a polymer of an acrylic monomer such as acrylic acid or acrylic acid ester; or a copolymer of an acrylic monomer and other monomers may be used, and examples of the other monomers include a vinyl-based monomer such as styrene or the like. Commercially available products may be used as the acrylic resin, and examples thereof include Mowinyl-Power 702, 7502, 7525, and 7320 (manufactured by Nippon Synthetic Chemicals Industry Co., Ltd.).

The content of the resin is preferably in the range of 1% by mass to 30% by mass, more preferably in the range of 5% by mass to 15% by mass, and still more preferably in the range of 5% by mass to 13% by mass based on the total mass of the ink, in terms of the solid content. When the content of the resin contained in the ink is within the above-described range and is especially not lower than the lower limit thereof, since the resin can sufficiently exert an effect of improving fixation of the ink, the friction resistance of the image being recorded is improved. In addition, when the content of the resin is not higher than the upper limit thereof, since the generation of the aggregates due to the resin is suppressed, the storage stability or discharging stability of the ink becomes excellent.

1.3. 2-Pyrrolidone-Based Solvent

The ink according to the present embodiment contains a 2-pyrrolidone-based solvent. By containing the 2-pyrrolidone-based solvent, the generation of aggregates generated due to the resin can be reduced. It is assumed that the 2-pyrrolidone-based solvent has a function of redissolving the aggregates generated due to the resin, but the reason thereof is not limited thereto. Aggregates can be dissolved even if aggregates are generated, as a result, the generation of the aggregates in the ink is suppressed. In this way, since the generation of the aggregates can be suppressed, the discharging stability of the ink is improved.

The 2-pyrrolidone-based solvent means a compound having a 2-pyrrolidone skeleton, for example, a compound having a substituent such as N-methyl-2-pyrrolidone, N-ethyl-2-pyrrolidone, or N-vinyl-2-pyrrolidone in addition to 2-pyrrolidone (that is, a compound having no substituent) can be used. The substituent is preferably an organic group such as a saturated or unsaturated hydrogen carbonate group having 1 to 5 carbon atoms. Among these, it is preferable to use 2-pyrrolidone from the viewpoint that 2-pyrrolidone has excellent storage stability of an ink and is excellently effective for suppressing generation of aggregates.

The content of the 2-pyrrolidone-based solvent is preferably in the range of 0.9% by mass to 8.1% by mass, more preferably in the range of 1% by mass to 8% by mass, still more preferably in the range of 1.1% by mass to 7.9% by mass, and particularly preferably in the range of 5% by mass to 7.9% by mass based on the total mass of the ink. When the content of the 2-pyrrolidone-based solvent is within the above-described range and is especially not lower than the lower limit, the generation of aggregates due to the resin can be sufficiently suppressed. In addition, when the content thereof is not higher than the upper limit, the viscosity of the ink is allowed to be in the appropriate range, so the discharging stability of the ink is improved.

The generation of aggregates due to the resin can be suppressed by adding a particular emulsifier in the ink in addition to use of the above-described 2-pyrrolidone-based solvent. However, when the particular emulsifier is used, the following defects may occur, so it is preferable to use the 2-pyrrolidone-based solvent.

That is, in the ink jet textile printing, a pretreatment may be performed on the cloth using a pretreatment agent having a coagulant which reacts with the components contained in the ink in advance from the viewpoint of improving the coloring property of an image to be recorded. By doing this, since the components contained in the ink are aggregated due to the reaction of the components contained in the ink with the coagulant contained in the pretreatment agent, it becomes possible to improve the coloring property of the image to be recorded. However, since a particular emulsifier hinders the reaction of the coagulant contained in the pretreatment agent with the components contained in the ink in some cases, the coloring property of the image to be recorded may become insufficient. As the components included in the ink reacting with the coagulant, a pigment or a resin can be exemplified, and as the coagulant, a polyvalent metal compound (for example, calcium chloride or the like) can be exemplified.

On the other hand, when the 2-pyrrolidone-based solvent is used, an image with an excellent coloring property can be obtained because the functions of the pretreatment agent are not hindered.

1.4. Other Components

The ink may include water, an organic solvent, a surfactant, a pH adjusting agent, a preservative, and a fungicide.

Water

Water is a main medium of an ink and a component which is evaporated and dispersed by drying. Examples of the water include pure water such as ion exchange water, ultrafiltrated water, reverse osmosis water, or distilled water; and water in which ionic impurities are removed as much as possible such as ultrapure water. In addition, when water is sterilized by irradiating with an ultraviolet ray or adding hydrogen peroxide, it is possible to prevent fungi or bacteria from being colonizing when the ink is preserved for a long period of time. The content of water contained in the ink, which is not particularly limited, is preferably 50% by mass or more and more preferably in the range of 50% by mass to 95% by mass based on the total mass of the ink.

Organic Solvent

Examples of the organic solvent include 1-2-alkanediols, polyhydric alcohols, and glycol ethers. These can be used alone or in combination of two or more kinds thereof.

Examples of the 1,2-alkanediols include 1,2-propanediol, 1,2-butanediol, 1,2-pentanediol, 1,2-hexanediol, and 1,2-octanediol. Since the 1,2-alkanediols is excellent in uniformly wetting a recording medium such as cloth by increasing the wettability of the ink, an image without bleeding can be recorded. When the 1,2-alkanediols are included, the content thereof may be in the range of 1% by mass to 20% by mass based on the total mass of the ink.

Examples of the polyhydric alcohols include ethylene glycol, diethylene glycol, triethylene glycol, propylene glycol, dipropylene glycol, 1,3-propanediol, 1,3-butanediol, 1,3-pentanediol, 1,4-butanediol, 1,5-pentanediol, 1,6-hexanediol, 2,3-butanediol, 3-methyl-1,3-butanediol, 3-methyl-1,5-pentanediol, 2-methyl-1,3-propanediol, 2,2-dimethyl-1,3-propanediol, 2-methyl-2,4-pentanediol, trimethylol propane, and glycerin. The polyhydric alcohols can be preferably used from the viewpoint of reducing clogging or discharging defects by suppressing drying and solidification of the ink on a nozzle surface of the head. When the polyhydric alcohols are included, the content thereof may be in the range of 2% by mass to 20% by mass based on the total mass of the ink.

Examples of the glycol ethers include alkylene glycol monoether and alkylene glycol diether.

Examples of the alkylene glycol monoether include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, triethylene glycol monomethyl ether, triethylene glycol monoethyl ether, triethylene glycol monobutyl ether, tetraethylene glycol monomethyl ether, tetraethylene glycol monoethyl ether, propylene glycol monomethyl ether, propylene glycol monoethyl ether, dipropylene glycol monomethyl ether, and dipropylene glycol monoethyl ether.

Examples of the alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, triethylene glycol dimethyl ether, triethylene glycol diethyl ether, triethylene glycol dibutyl ether, triethylene glycol butyl methyl ether, tetraethylene glycol dibutyl ether, propylene glycol dimethyl ether, propylene glycol diethyl ether, dipropylene glycol dimethyl ether, and dipropylene glycol diethyl ether.

Since the glycol ethers can suppress wettability or penetration speed of the ink on the recording medium, a clear image can be recorded. When the glycol ethers are included, the content thereof may be in the range of 0.05% by mass to 6% by mass based on the total mass of the ink.

Surfactant

A surfactant has a function of improving the wettability with respect to the recording medium by reducing surface tension. Among surfactants, for example, an acetylene glycol-based surfactant, a silicone-based surfactant, and a fluorine-based surfactant may be preferably used.

Examples of the acetylene glycol-based surfactant, which are not particularly limited, include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (all trade names, manufactured by Air Products and Chemicals. Inc.); Olefin B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (all trade names, Nissin Chemicals Co., Ltd.), and Acetylenol E00, E00P, E40, and E100 (all trade names, manufactured by Kawaken Fine Chemicals. Co., Ltd.).

As a preferable example of the silicone-based surfactant, which is not particularly limited, a polysiloxane-based compound is exemplified. As the polysiloxane-based compound, which is not particularly limited, for example, polyether-modified organosiloxane is exemplified. Examples of the commercially available products of the polyether-modified organosiloxane include BYK-306, BYK-307, BYK-333, BYK-341, BYK-345, BYK-346, and BYK-348 (all trade names, manufactured by BYK Co., Ltd.); KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (all trade names, manufactured by Shin-Etsu Chemicals Co., Ltd.).

As the fluorine-based surfactant, a fluorine-modified polymer is preferably used, and, as a specific example thereof, BYK-340 (trade name, manufactured by BYK Co., Ltd.) is exemplified.

pH Adjusting Agent

It is preferable that the ink according to the present embodiment include a pH adjusting agent. As described below, examples of the pH adjusting agent are not particularly limited as long as the pH of the ink is adjusted to be in the range of 9.2 to 10.5, and an organic base or an inorganic base can be exemplified.

Examples of the organic base include alkanolamines such as triethanolamine, diethanolamine, monoethanolamine, and tri-iso-propanolamine. Here, the organic bases are required to be added in a relatively large amount (about 2% to 3% based on the total mass of the ink) in order for the pH of the ink to be in the range of 9.2 to 10.5 using these organic bases. Accordingly, this may cause problems such as an odor or the viscosity of the ink being increased because the viscosity of the organic base itself is high. In addition, there is limitation on the organic base adjusting the pH to the alkali side.

Meanwhile, an inorganic base does not have a problem of an odor or the like and is able to adjust the pH to the alkali side with a small amount thereof, so it is easy for the viscosity of the ink to be in the appropriate range. For example, alkali metal such as rithium hydroxide, sodium hydroxide, potassium hydroxide, or calcium hydroxide; or a strong base as a hydroxide of alkali earth metal can be used as the inorganic base.

When the inorganic base is used as a pH adjusting agent, the content thereof may be determined such that the pH of the ink is adjusted to be in the range of 9.2 to 10.5, but the content thereof can be adjusted to be in the range of 0.03% by mass to 0.12% by mass.

Preservative and Fungicide

Examples of the preservative and fungicide include sodium benzoate, sodium pentachlorophenol, 2-pyridinethiol-1-sodium oxide, sodium sorbic acid, sodium dehydro acetate, 1,2-dibenzine thiazoline-3-one (Proxel CRL, Proxel BND, Proxel GXL, Proxel XL-2, and Proxel TN manufactured by Imperial Chemical Industries).

1.5. Preparation Method

The ink according to the present embodiment can be obtained by mixing the above-described components in an arbitrary order and removing impurities by filtration or the like as needed. As the method of mixing each component, a method of stirring and mixing materials by sequentially adding the materials to a container equipped with a stirrer such as a mechanical stirrer or a magnetic stirrer is preferably used. As the filtration method, a centrifugal filtration or a filter filtration can be performed as needed.

1.6. Physical Property

The pH of the ink according to the present embodiment is in the range of 9.2 to 10.5 and preferably in the range of 9.3 to 10.4. When the pH thereof is in the above-described range, since the increase in the viscosity of the ink or aggregation of the pigment or the like can be suppressed, the storage stability of the ink becomes excellent. Further, it is found that when the pH thereof is in the above-described range, the 2-pyrrolidone-based solvent considerably improves the function of suppressing the generation of aggregates due to the resin in the case of containing the 2-pyrrolidone-based solvent. Therefore, the generation of aggregates due to the resin can be effectively suppressed. The cause thereof is not clear, but it is assumed that when the pH is in the above-described range, the generation of aggregates due to the resin is suppressed or the redissolution of aggregates due to the 2-pyrrolidone-based solvent is promoted. However, the cause thereof is not limited thereto. On the other hand, when the pH of the ink is less than the above-described range, since the generation of aggregates may not be possible to be suppressed, the discharging stability of the ink tends to be reduced. In addition, when the pH of the ink is higher than the above-described range, since the increase in the viscosity of the ink or aggregation of the pigment or the like is generated, the storage stability of the ink tends to be reduced. In addition, the pH thereof can be measured using, for example, a pH meter ("Portable PH Meter D-52S" (trade name), manufactured by Horiba, Ltd.).

The surface tension of the ink according to the present embodiment at a temperature of 20° C. is preferably in the range of 20 mN/m to 40 mN/m and more preferably in the range of 25 mN/m to 35 mN/m from the viewpoint of balancing between the image quality and the reliability as the ink for ink jet textile printing. Further, the surface tension can be measured by confirming the surface tension at the time of wetting a platinum plate with the ink in the environment of a temperature of 20° C. using an Automatic Surface Tension Analyzer CBVP-Z (trade name, manufactured by Kyowa Interface Science Co., Ltd.).

Further, from these viewpoints, the viscosity of the ink according to the present embodiment at a temperature of 20° C. is preferably in the range of 3 mPa·s to 10 mPa·s and more preferably in the range of 3 mPa·s to 8 mPa·s. In addition, the measurement of the viscosity can be performed by measuring the viscosity in the environment of a temperature of 20° C. using a viscoelasticity tester MCR-300 (trade name, manufactured by Physica Co., Ltd.).

2. Ink Jet Textile Printing Apparatus

An ink jet textile printing apparatus according to an embodiment of the invention includes a head which has a supply channel through which the ink for the ink jet textile printing flows and a nozzle which is connected to the supply channel and discharges the ink, and at least one of a valve unit and a filter unit.

Hereinafter, the ink jet textile printing apparatus according to the invention will be described with an example of an on-carriage type printer in which an ink cartridge is installed on a carriage. In addition, the printer of the ink jet textile printing apparatus according to the invention is not limited to the on-carriage type printer, it may be an off-carriage type printer in which an ink cartridge is not installed on a carriage but is fixed to the outside.

Further, the printer used in the description below is a serial printer in which a head is installed on a carriage which moves in a predetermined direction and the head discharges liquid droplets on a recording medium when the head moves along with the movement of the carriage. Further, the ink jet textile printing apparatus according to the invention is not limited to the serial printer, it may be a line printer in which a head is widely formed than the width of a recording medium and the head discharges liquid droplets on the recording medium without being moved.

In each of the figures used for the description below, the scale of each member is appropriately changed since each member is required to be big enough to be recognizable.

Figure 2:
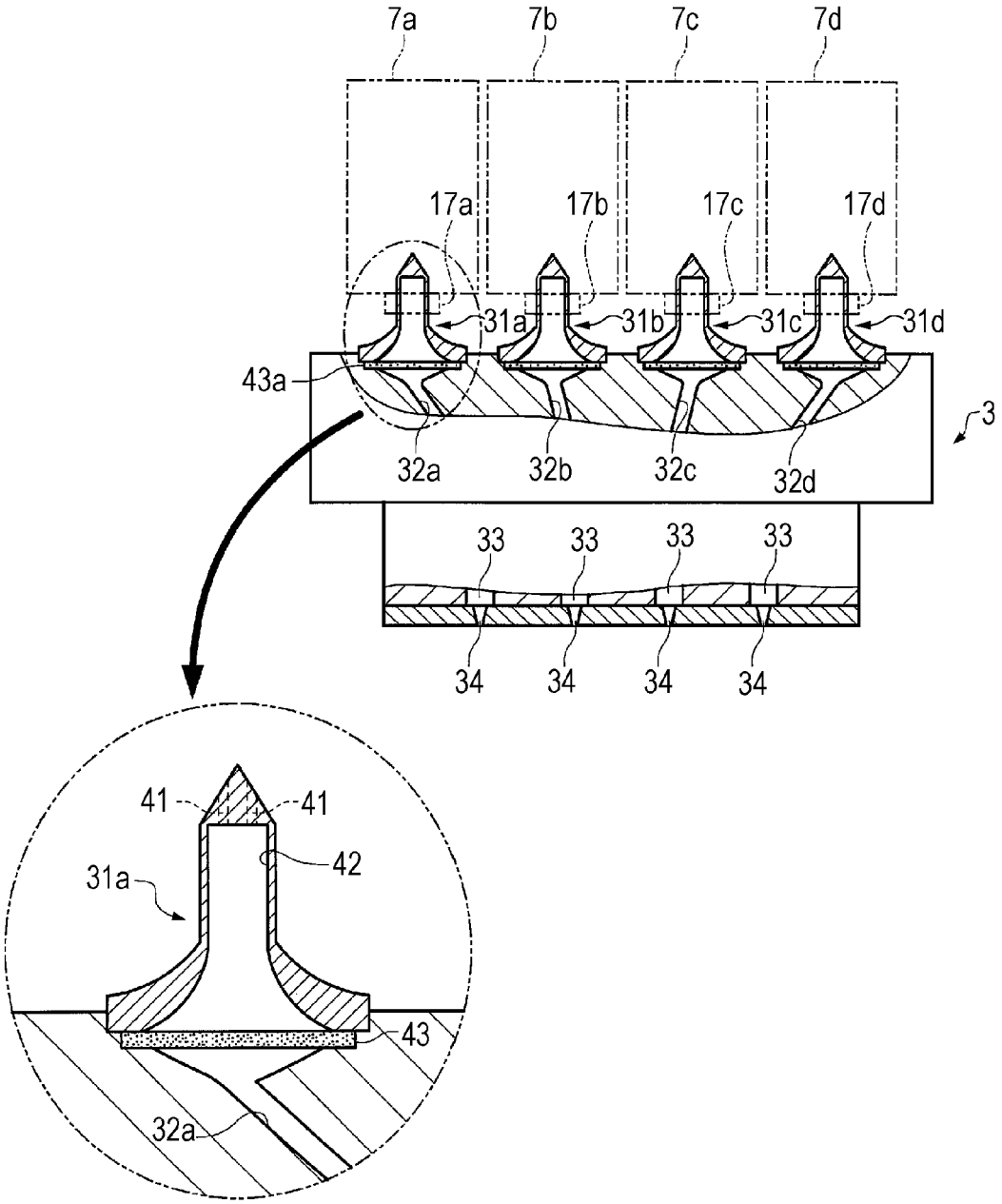
FIG. 2 is a partly enlarged side view schematically illustrating a structure of a peripheral part of a head in the ink jet textile printing apparatus according to the present embodiment.

FIG. 1 is a perspective view schematically illustrating a printer as an example of the ink jet textile printing apparatus according to the present embodiment. FIG. 2 is a partly enlarged side view schematically illustrating a structure of a peripheral part of a head in the printer.

In the example of FIG. 1, a printer 1 includes a head 3, a carriage 4 on which the head 3 is installed and on which ink cartridges 7*a* to 7*d* are detachably mounted, a main scanning mechanism 5 which allows the carriage 4 to reciprocate in a medium width direction, and a platen roller 6 which transfers the recording medium 2 in a medium feeding direction. Further, the printer 1 includes a control unit (not shown in the figure) which controls operations of the entire printer 1. In addition, the medium width direction means a main scanning direction (a head scanning direction) and the medium feeding direction means a sub-scanning direction (a direction orthogonal to the main scanning direction).

The main scanning mechanism 5 includes a timing belt 8 which is connected to the carriage 4, a motor 9 which drives the timing belt 8, and a guide shaft 10 which is a supporting member arranged in the main scanning direction. The carriage 4 is driven by the motor 9 through the timing belt 8 and is reciprocated along with the guide shaft 10 in the main scanning direction.

In the example of FIG. 1, the ink cartridges 7*a* to 7*d* are formed of independent 4 ink cartridges. The ink cartridges 7*a* to 7*d* respectively store the above-described inks for ink jet textile printing, which contain pigments of black, magenta, cyan, and yellow. In the example of FIG. 1, the number of ink cartridges is 4, but the number thereof is not limited thereto, a desired number of cartridges can be installed. At the bottom of the ink cartridges 7*a* to 7*d*, derivation units 17*a* to 17*d* for deriving the inks from each of the ink cartridges are provided.

The head includes a supply channel through which the ink for above-described ink jet textile printing flows and a nozzle which is connected to the supply channel and discharges the ink. In the example of FIG. 2, the head 2 includes needle members 31*a* to 31*d* which are connected to the derivation units 17*a* to 17*d*, communicating passages 32*a* 32*d* which communicate with the needle members 31*a* to 31*d*, a liquid storing chamber (reservoir, not shown in the figure) which communicates with the communicating passages 32*a* to 32*d*, a pressure generating chamber (cavity) 33 which communicates with the liquid storing chamber, and a nozzle 34 which communicates with the pressure generating chamber 33.

The needle members 31*a* to 31*d* include an introduction hole 41 and an introduction passage 42. An end of the introduction passage 42 is connected to the introduction hole 41 and the other end thereof is connected to the communicating passages 32*a* to 32*d*.

In the example of FIG. 2, after the inks stored in the ink cartridges 17*a* to 17*d* are introduced to the introduction passage 42 through the introduction hole 41, communicate with the communicating passages 32*a* to 32*d*, and are discharged from the nozzle 34 via the liquid storing chamber (reservoir) and the pressure generating chamber (cavity) 33. Specifically, when a pressure generator (not shown in the figure) disposed in the pressure generating chamber 33 is driven, the pressure of the pressure generating chamber 33 is changed, and liquid droplets of the ink from the opening of the nozzle 34 are discharged.

The term "supply channel" in aspects means a portion communicating with the ink in the head and means an introduction hole 41, an introduction passage 42, and communicating passages 32*a* to 32*d* in the example of FIG. 2.

The ink jet textile printing apparatus according to the present embodiment includes at least one of the filter unit and the valve unit.

The filter unit is provided in the supply channel of the ink to the head for capturing foreign materials such as dust contained in the ink such that the foreign materials are not supplied to the head. The filter unit includes a mesh-like filter member which is formed by knitting a metallic wire or the like. Specifically, in the example of FIG. 2, the filter unit 41*a* (filter member 43*a*) is disposed at a portion connecting the introduction passage 42 and the communicating passage 32*a*. As shown in FIG. 2, when the introduction passage 42 has a structure in which the introduction passage widens toward to a circulation direction of the ink, a passing area of the ink can be increased in the filter member 43*a*, so a flow resistance generated when the ink passes can be decreased.

Here, the filter unit is one of portions in which bubbles are the most easily retained in the supply channel. For this reason, a gas-liquid interface is easily generated in the filter unit because the supplied ink is in contact with the bubbles (air). Since the resin contained in the ink easily forms a film, aggregates due to the resin are particularly easily generated at the gas-liquid interface. As a result, the filter member is blocked, so the discharging stability of the ink is degraded. Even when the ink jet printer including the filter unit is used, if the above-described ink for ink jet textile printing is used, the generation of aggregates at the gas-liquid interface can be considerably suppressed by the operation of the 2-pyrrolidone-based solvent contained in the ink. Accordingly, the ability of the filter unit is sufficiently exhibited, so an ink jet textile printing apparatus with excellent discharging stability can be obtained.

Further, when the area of one filter member 43*a* is in the range of 7 $mm^2$ to 120 $mm^2$, the flow resistance generated when the ink passes can be reduced while the ability of capturing the foreign materials of the filter is secured, so the space occupied by the filter can be reduced. However, since bubbles are captured in the filter member 43*a*, the gas-liquid interface becomes easily generated in the ink existing in the vicinity of the filter due to the bubbles, so aggregates due to the resin contained in the ink become easily generated. Even in such a case, when the above-described ink for ink jet textile printing is used, the generation of aggregates at the gas-liquid interface can be significantly suppressed by the operation of the 2-pyrrolidone-based solvent.

Figure 3:
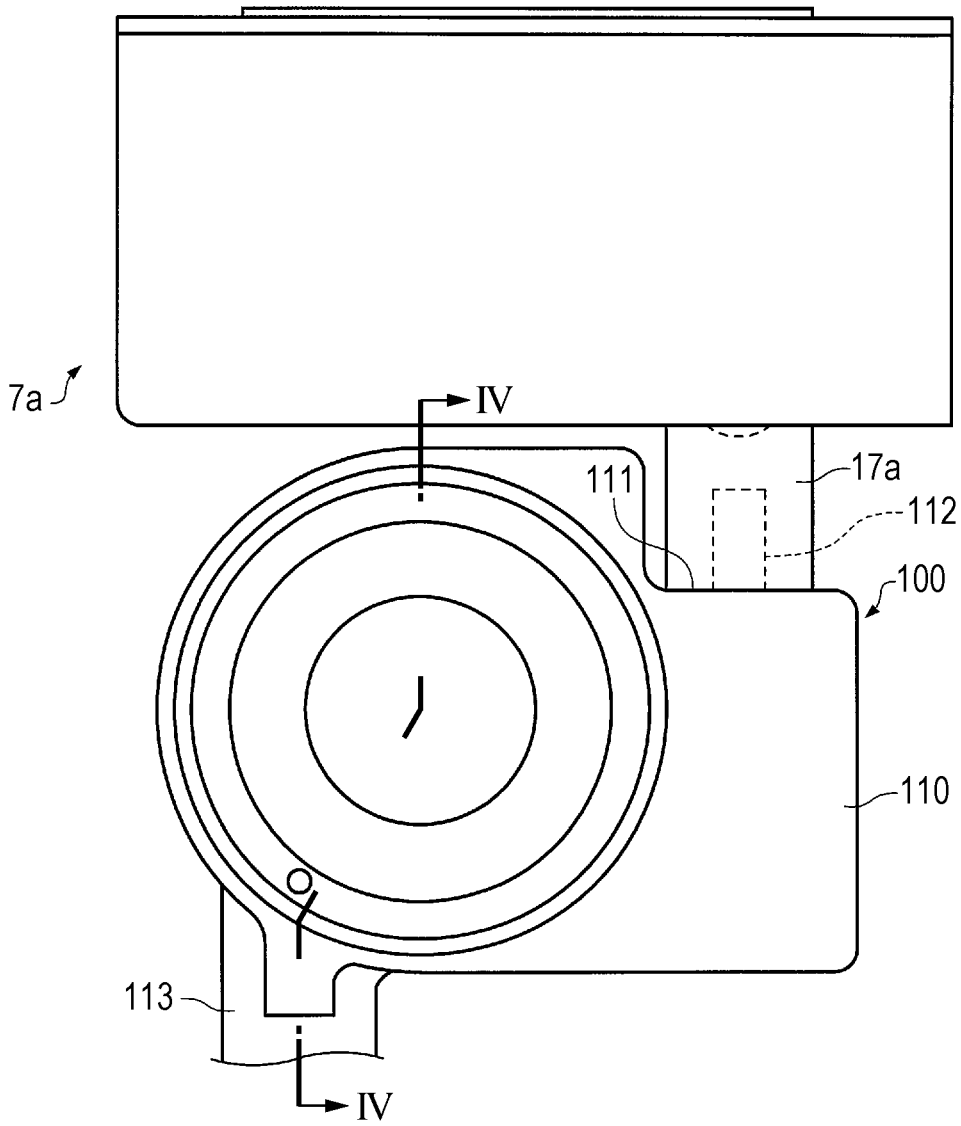
FIG. 3 is a side view schematically illustrating the connection state between a valve unit and an ink cartridge in the ink jet textile printing apparatus according to the present embodiment.

The valve unit is connected to the head and restricts the flow of the ink supplied to the head. FIG. 3 is a side view schematically illustrating the connection state between the valve unit and the ink cartridge. In the example of FIG. 3, for the convenience of description, only the connection state between one valve unit 100 and one ink cartridge 7*a* is illustrated, but a plurality of valve units 100 can be provided for each of the ink cartridges 7*a* to 7*d*.

In the example of FIG. 3, the valve unit 100 includes a synthetic resin unit case 110. The unit case 110 is formed in a flat box shape and includes a semicylindrical portion whose upper portion has a stage portion 111 formed thereon. A supply needle 112 projecting upside is formed on the stage portion 111. When the supply needle 112 is fitted to the derivation unit 17*a* of the ink cartridge 7*a*, the ink inside the ink cartridge 7*a* is supplied to the supply needle 112, and flows in the valve unit 100.

In addition, an ink deviation unit 113 projecting downside is formed on a lower portion of the unit case 110. When the ink deviation unit 113 is connected to the needle member 31*a* of the head 3, the ink in the valve unit flows to the inside the head 3 from the ink deviation unit 113.

Figure 4A:
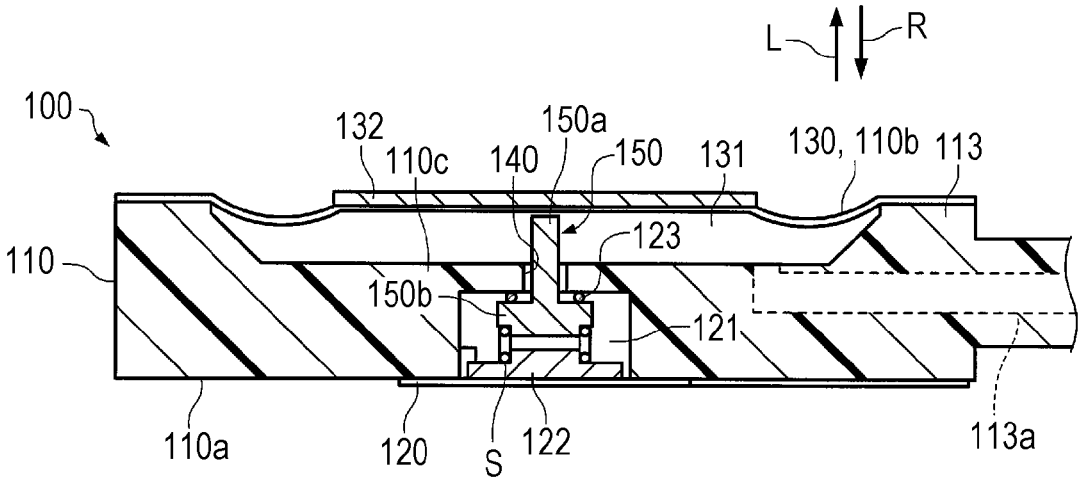
FIGS. 4A and 4B are schematic views illustrating an internal structure of the valve unit in the ink jet textile printing apparatus according to the present embodiment.
Figure 4B:
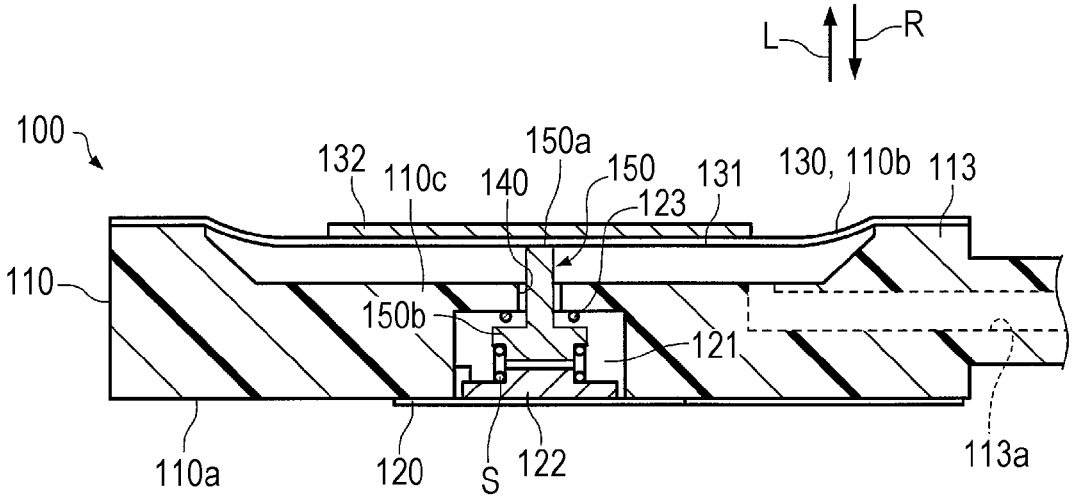

FIGS. 4A and 4B are schematic views illustrating an internal structure of the valve unit 100, and cross-sectional views taken along line IV-IV of FIG. 3. Specifically, FIG. 4A illustrates the state of a closed valve of a pressure adjusting valve 150 and FIG. 4B illustrates the state of an opening valve of the pressure adjusting valve 150.

In the examples of FIGS. 4A and 4B, the introduction chamber 121 and the pressure chamber 131 is partitioned by a partition wall 110*c*. The partition wall 110*c* is provided with a supporting hole 140 and the introduction chamber 121 can communicate with the pressure chamber 131 by the supporting hole 140.

The introduction chamber 121 temporarily stores the ink supplied from the ink cartridge 7*a*. The introduction chamber 121 includes a surface (film member 120) which is partitioned by a part of a first side surface 110*a* of the unit case 110. A spring bearing member 122 connected to the film member 120 and a spring member S engaged with the spring bearing member 122 are disposed in the introduction chamber 121.

The pressure chamber 131 includes a connection portion (that is, a connected portion with the supporting hole 140) which is connected to the introduction chamber 121 through the pressure adjusting valve 150 and a connection portion (that is, a connected portion with an introduction passage 113*a* of FIGS. 4A and 4B) which is connected to the supply channel (see FIG. 2) of the head. Further, the pressure chamber 131 includes a surface (film member 130) which is partitioned by a part of a second side surface 110*b* of the unit case 110. A disk-like pressure receiving plate 132 is attached to a surface which is in the opposite side to the pressure chamber 131 of the film member 130.

The pressure adjusting valve 150 constituting a switch valve is slidably supported by the supporting hole 140. The pressure adjusting valve 150 is formed by integrating a rod 150*a* inserted to the supporting hole 140 and a disk-like plate portion 150*b*. The tip of the rod 150*a* is formed to be abuttable on the film member 130 constituting a part of the wall of the pressure chamber 131. Further, the plate-like portion 150*b* is disposed in the introduction chamber 121, and biased in an R direction by the spring member S (FIG. 4A). Furthermore, an annular seal member 123 is fixed to the introduction chamber 121 side of the partition wall 110*c* such that the seal member encloses the supporting hole 140.

The pressure adjusting valve 150 is generally in the position as shown in FIG. 4A by the biasing force of the spring member S and the plate-like portion 150*b* is press-contacted to the seal member 123 to enclose the vicinity of the supporting hole 140 and blocks the introduction chamber 121 and the pressure chamber 131 (state of the closed valve of the pressure adjusting valve 150, see FIG. 4A).

On the other hand, when the ink of the pressure chamber 131 is consumed and the inner pressure thereof is decreased not more than a predetermined value, the pressure receiving plate 132 is interlocked with deflection of the film member 130 and moves in the R direction. Thus, the pressure receiving plate 132 pushes in the rod 150*a* in the R direction, and the plate-like portion 150*b* is separated from the seal member 123, and then the introduction chamber 121 communicates with the pressure chamber 131 (state of the opening valve of the pressure adjusting valve 150, see FIG. 4B). At this time, the ink flows in the pressure chamber 131 from the introduction chamber 121, and the inner pressure of the pressure chamber 131 is compensated, so the state thereof returns to the closed valve state. In this way, by repeating the opening valve state and the closed valve state, the inner pressure of the pressure chamber 131 is maintained in a predetermined value.

Here, the valve unit is one of portions in which bubbles are easily retained in the same way as the above-described filter unit. For this reason, a gas-liquid interface is easily generated in the valve unit because the supplied ink is in contact with the bubbles (air). Since the resin contained in the ink easily forms a film, aggregates due to the resin are particularly easily generated at the gas-liquid interface. As a result, the aggregates block the supply channel of the head and the nozzle, so the discharging stability of the ink is degraded. Even when the ink jet printer including the filter unit is used, if the above-described ink for ink jet textile printing is used, the generation of aggregates at the gas-liquid interface can be significantly suppressed by the operation of the 2-pyrrolidone-based solvent contained in the ink.

Further, when the volume of one pressure chamber 131 is in the range of 400 $mm^3$ to 5000 $mm^3$, the inner pressure of the pressure chamber 131 is easily maintained in a predetermined value, and the valve unit can be downsized while the supply of the ink to the head is accurately restricted. Meanwhile, since the bubbles are easily retained in the pressure chamber 131, the gas-liquid interface becomes easily generated in the ink inside the pressure chamber 131 due to the bubbles, so aggregates due to the resin contained in the ink become easily generated. Even in such a case, when the above-described ink for ink jet textile printing is used, the generation of aggregates at the gas-liquid interface can be significantly suppressed by the operation of the 2-pyrrolidone-based solvent.

3. Ink Jet Textile Printing Method

An ink jet textile printing method according to an embodiment of the invention includes an image forming process of forming an image by attaching liquid droplets of the ink for ink jet textile printing to the cloth.

More specifically, it is preferable that a coagulant such as a polyvalent metal compound be contained in the area of the cloth on which an image is formed from the viewpoint of improving a coloring property of the image to be recorded. Accordingly, for example, it is preferable to include a pretreatment process of applying a pretreatment agent, before the image forming process, which contains the polyvalent metal compound in the area of the cloth on which an image is formed.

As described above, the ink for ink jet textile printing can suppress the generation of aggregates and has excellent storage stability. Therefore, the ink jet textile printing method according to the present embodiment using the ink has excellent discharging stability of the ink.

The ink jet textile printing method according to the present embodiment can be implemented using the above-described ink jet textile printing apparatus to which the above-described ink for ink jet textile printing is applied.

Hereinafter, each process will be described in detail.

3.1. Pretreatment Process

It is preferable that the ink jet textile printing method according to the present embodiment include a pretreatment process. The pretreatment process is a process of applying a pretreatment agent containing a coagulant which reacts with the components of an ink to the area of the cloth in which the first image is formed, before the image forming process.

The coagulant has a function of aggregating pigments contained in the ink by being reacted with the resin contained in the ink. In this way, the coloring property of the image formed by the ink is improved, and the cloth can be concealed in an excellent manner. Examples of the components contained in the ink which react with the coagulant include the above-described pigments and resins.

In the ink jet textile printing method according to the present embodiment, when non-white cloth is used as the cloth and a non-white-based ink is used, since the coloring property of the image to be recorded can be significantly degraded, it is particularly preferable to include the pretreatment process. Since the ink of the present embodiment does not inhibit the reaction of the component contained in the ink with the aggregates contained in the cloth, it is particularly useful in the case in which a white-based ink is used for recording on non-white cloth as the cloth.

The pretreatment process may include a unit of immersing the cloth in a pretreatment agent or a unit of coating or spraying the pretreatment agent.

In addition, the ink jet textile printing method according to the present embodiment may include a process of drying the pretreatment agent applied to the cloth, after the pretreatment process and before the image forming process. As a drying unit of drying the pretreatment agent, a known unit may be used, but the example is not particularly limited.

The polyvalent metal component contained in the pretreatment agent is a component formed of polyvalent metal ion whose valence is 2 or more and anion. Examples of the polyvalent metal ion whose valence is 2 or more include $Ca^{2+}$, $Mg^{2+}$, $Cu^{2+}$, $Ni^{2+}$, $Zn^{2+}$, and $Ba^{2+}$. Examples of anion include $Cl^-$, $NO_3^-$, $CH_3COO^-$, $I^-$, $Br^-$, and $ClO_3^-$. Among these, magnesium salts, calcium salts, or ammonium salts can be preferably used from the viewpoint of further improving the above-described effects of aggregating. Other examples of the coagulant being used include organic acids, polyallylamine, and a polyallylamine derivative.

The pretreatment agent may include a resin. Examples of the resin, which are not particularly limited, include known resins such as an acrylic resin, a styrene acrylic resin, a fluorene-based resin, a urethane-based resin, a polyolefin-based resin, and a vinyl ethylene acetate-based resin.

The pretreatment agent may contain components such as a surfactant, a paste (for example, a starch substance, a cellulose-based substance, polysaccharides, a protein, or a water-soluble polymer), organic acids, water, a pH adjusting agent, a preservative, and a fungicide.

3.2. Image Forming Process

The image forming process is a process of forming an image by attaching the above-described ink to the cloth.

3.3. Other Processes

The ink jet textile printing method according to the present embodiment may include a heating process of heating the cloth, which is performed after the image forming process. In other words, the heating process is a process of drying the image formed on the cloth. By performing this process, an image with excellent friction resistance can be obtained because the resin contained in each ink sufficiently forms a film. Examples of the heating method used for the heating process, which are not particularly limited, include a heat press method, a normal pressure steam method, a high pressure steam method, and a thermofix method. In addition, as a source of heat, which is not particularly limited to the following, for example, infrared light (lamp) is exemplified. Further, the temperature at the time of heating process may be set to, for example, 150° C. to 200° C., which is the temperature range in which the resin contained in each ink can be fused and moisture can be volatized.

After the heating process, the printed matters may be washed and dried. At this time, a soaping process, that is, a process of washing off the non-fixed pigment with a heated soap liquid may be performed.

4. Examples

Hereinafter, the embodiments of the invention will be specifically described with reference to examples, but the present embodiments are not limited to the examples.

4.1. Preparation of Ink

After preparing a pigment dispersing liquid, the inks of Examples and Comparative Examples were obtained using the pigment dispersing liquid.

The pigment dispersing liquid used for the ink was prepared as follows. 7.5 parts by mass of an acrylic acid-acrylic acid ester copolymer (weight average molecular weight: 25000, acid value: 180) as a resin dispersant was added to 76 parts by mass of ion exchange water, in which 1.5 parts by mass of a 30% ammonia aqueous solution (neutralizing agent) was dissolved, and then dissolved therein. Subsequently, 15 parts by mass of a magenta pigment (C.I. Pigment Red 122) was added thereto and a dispersing treatment is performed in a ball mill using zirconia beads for 10 hours, thereby obtaining a pigment dispersing liquid (pigment content 15%).

Subsequently, each component was put into a container such that the components have the compositions as listed in Tables 1 and 2, and stirred and mixed with a magnetic stirrer for 2 hours using the pigment dispersing liquid, and then the resultant was filtered with a membrane filter having a pore size of 5 μm. In this way, the inks of Examples and Comparative Examples were obtained. Further, all the numerical values in Tables 1 and 2 are on a % by mass basis, and the ion exchange water was added such that the total mass of the ink became 100% by mass.

TABLE 1

| Composition of ink | | Examples | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Pigment | Magenta pigment | 5.00 | 5.00 | 5.00 | 5.00 | 5.00 | 5.00 | 5.00 | 5.00 | 5.00 | 5.00 | 5.00 |
| Resin | Takelac WS-6021 | 22.00 | 22.00 | 22.00 | 22.00 | 22.00 | 22.00 | 22.00 | 22.00 | 22.00 | | |
| | Superflex 150 | | | | | | | | | | 22.00 | |
| | Superflex 126 | | | | | | | | | | | 22.00 |
| 2-pyrrolidone-based solvent | 2-pyrrolidone | 0.90 | 1.10 | 5.00 | 7.90 | 8.10 | 5.00 | 5.00 | 1.10 | 7.90 | 0.90 | 0.90 |
| Organic solvent | Glycerin | 10.00 | 9.00 | 6.00 | 4.00 | 3.00 | 6.00 | 6.00 | 9.00 | 4.00 | 10.00 | 10.00 |
| | Triethylene glycol | 3.00 | 3.00 | 3.00 | 3.00 | 3.00 | 3.00 | 3.00 | 3.00 | 3.00 | 3.00 | 3.00 |
| | Triethylene glycol monobutyl ether | 1.00 | 1.00 | 1.00 | 1.00 | 1.00 | 1.00 | 1.00 | 1.00 | 1.00 | 1.00 | 1.00 |
| Surfactant | BYK-348 | 0.30 | 0.30 | 0.30 | 0.30 | 0.30 | 0.30 | 0.30 | 0.30 | 0.30 | 0.30 | 0.30 |
| pH adjusting agent | Potassium hydroxide | 0.07 | 0.07 | 0.07 | 0.07 | 0.07 | 0.03 | 0.12 | 0.03 | 0.12 | 0.07 | 0.07 |
| | Triethanolamine | | | | | | | | | | | |
| water | Ion exchange water | Residual amount | Residual amount | Residual amount | Residual amount | Residual amount | Residual amount | Residual amount | Residual amount | Residual amount | Residual amount | Residual amount |
| Total (% by mass) | | 100 | 100 | 100 | 100 | 100 | 100 | 100 | 100 | 100 | 100 | 100 |
| Physical property | Ink pH | 9.6 | 9.6 | 9.6 | 9.6 | 9.6 | 9.3 | 10.4 | 9.3 | 10.3 | 9.6 | 9.6 |
| Evaluation results | Filter aggregates | Δ | ○ | ⊙ | ⊙ | ○ | ○ | ⊙ | ○ | ⊙ | ○ | ⊙ |
| | Discharging stability | ⊙ | ⊙ | ⊙ | ⊙ | Δ | ○ | ⊙ | ○ | ○ | ⊙ | ⊙ |
| | Storage stability | ⊙ | ⊙ | ⊙ | ○ | ○ | ⊙ | ○ | ⊙ | ○ | ⊙ | ⊙ |

TABLE 2

| Composition of ink | | Comparative Examples 1 | 2 | 3 | 4 | 5 |
|---|---|---|---|---|---|---|
| Pigment | Magenta pigment | 5.00 | 5.00 | 5.00 | 5.00 | 5.00 |
| Resin | Takelac WS-6021 | 22.00 | 22.00 | 22.00 | 22.00 | 22.00 |
| | Superflex 150 | | | | | |
| | Superflex 126 | | | | | |
| 2-pyrrolidone-based solvent | 2-pyrrolidone | | 5.00 | 5.00 | 5.00 | 5.00 |
| Organic solvents | Glycerin | 11.00 | 6.00 | 6.00 | 6.00 | 6.00 |
| | Triethylene glycol | 3.00 | 3.00 | 3.00 | 3.00 | 3.00 |
| | Triethylene glycol monobutyl ether | 1.00 | 1.00 | 1.00 | 1.00 | 1.00 |
| Surfactant | BYK-348 | 0.30 | 0.30 | 0.30 | 0.30 | 0.30 |
| pH adjusting agent | Potassium hydroxide | 0.07 | | | 0.01 | 0.20 |
| | triethanolamine | | | 0.50 | | |
| Water | Ion exchange water | Residual amount | Residual amount | Residual amount | Residual amount | Residual amount |
| Total (% by mass) | | 100 | 100 | 100 | 100 | 100 |
| Physical property | Ink pH | 9.5 | 8.6 | 9.0 | 9.1 | 10.6 |
| Evaluation results | Filter aggregates | X | X | X | X | ○ |
| | Discharging property | ⊙ | Δ | Δ | Δ | ⊙ |
| | Storage property | ○ | ⊙ | ⊙ | ⊙ | X |

In Tables 1 and 2, the components described other than the compound names are as follows.

Pigment

Magenta pigment (C.I. Pigment Red 122)

Resin

Takelac WS-6021 (trade name, manufactured by Mitsui Polyurethane Chemicals, Inc., anionic ether-based urethane resin emulsion, self-emulsifying type, solid content 30%, coating elongation 750%)

Superflex 150 (trade name, manufactured by Dai-ichi Kogyo Seiyaku Co., Ltd., anionic ester ether type urethane resin aqueous dispersion, self-emulsifying type, solid content 30%, coating elongation 330%)

Superflex 126 (trade name, manufactured by Dai-ichi Kogyo Seiyaku Co., Ltd., anionic ester ether type urethane resin aqueous dispersion, self-emulsifying type, solid content 30%, coating elongation 87%)

Others

BYK-348 (trade name, manufactured by BYK Co., Ltd., silicone-based surfactant)

Further, the coating elongation of the resin obtained using a Tensilon universal tester RTC-1225A (trade name, manufactured by Orientec Co., Ltd.) with the method described above.

In addition, the pH of each ink was measured using, for example, a pH meter ("Portable PH Meter D-52S" (trade name), manufactured by Horiba, Ltd.).

4.2. Evaluation Test 4.2.1. Filter Aggregates

An ink cartridge of an ink jet printer ("Epson MJ-3000C" (trade name), manufactured by Seiko Epson Corp.) was filled with the ink prepared as described above. In addition, the ink jet printer was filled with each ink under the condition of 40° C. and 20% RH. In addition, printing was performed on an A4-size recording medium for 100 sheets per a day and the printer was stopped at the time for which the printing was not performed. Further, the ink in the head was absorbed from the nozzle, and the ink in the ink passage supplying the ink to the head from the head and the ink cartridge was replaced with a new ink (refreash) for once a weak. After 30 days, the aggregates captured by the filter member (pore size: 10 μm) in the head were observed with a microscope and the coating ratio of the aggregates to the filter member was calculated. The evaluation criteria are as follows and the evaluation results are listed in Tables 1 and 2.

In addition, the printer includes both of a filter unit and a valve unit as shown in FIGS. 2 to 4B as described above. Further, the volume of the pressure chamber of the filter unit is 2000 $mm^3$ and the area of the filter member of the filter unit is 80 $mm^2$.

⊙: The coating ratio of the filter member was 0% (with no aggregates).

○: The coating ratio of the filter member was less than 1%.

Δ: The coating ratio of the filter member was in the range of 1% to less than 3%.

x: The coating ratio of the filter member was more than and equal to 3%.

4.2.2. Discharging Stability

The discharging stability was evaluated by discharging the ink from the nozzle of the 30-day-passed printer using the above-described filter aggregates test and visually verifying the recorded nozzle check pattern. The evaluation criteria are as follows and the evaluation results are listed in Tables 1 and 2.

⊙: Bending of the discharging direction or the clogging of the nozzle was not generated.

○: The clogging of the nozzle was not generated but the bending of the discharging direction was slightly generated.

x: The clogging of the nozzle was generated.

4.2.3. Storage Stability 10 mL of the obtained ink was added to a sample bottle, and the bottle was sealed and then left as is at 70° C. for 6 days. Subsequently, the rate of change in viscosity of the ink, the rate of change in the particle size of the pigment contained in the ink, and the rate of change in the surface tension of the ink were measured. Specifically, the rate of change in viscosity was obtained by measuring the viscosity before and after the preservation at 20° C. using a viscoelasticity tester MCR-300 (trade name, manufactured by Physica Co., Ltd.). Further, the rate of change in the particle size was obtained by measuring the particle size of the pigment before and after the preservation using a particle size analyzer (for example, "MICROTRAC UPA", manufactured by Nikkiso Co., Ltd.) with a dynamic light scattering method as a measurement principle. The change in the surface tension was obtained by measuring the surface tension when a platinum plate was wetted with the ink before and after the preservation in the environment of a temperature of 20° C. using an Automatic Surface Tension Analyzer CBVP-Z (trade name, manufactured by Kyowa Interface Science Co., Ltd.).

⊙: The rates of change in all physical properties were less than 3%.

○: The rates of change in all physical properties were less than 5%, but the rate of change in at least one physical property was less than and equal to 3%.

x: The rate of change in at least one physical property was more than and equal to 5%.

4.2.4. Tension Test

The following tension test was performed in order to examine the influence of the coating elongation of the resin contained in the ink.

An image was formed by attaching each of the ink of Example 1, the ink of Example 10, and the ink of Example 11 to a 20 cm×20 cm area of the cloth (Heavy weight, manufactured by HANES Inc., 100% cotton, blue texture) using an ink jet recording apparatus ("Epson MJ-3000C" (trade name), manufactured by Seiko Epson Corp.). Subsequently, printed matters according to Reference Examples 1 to 3 were obtained by performing a heat treatment using a heat press machine at 160° C. for 1 minute. As the printing condition, recording resolution was set to 1440 dpi×1440 dpi. In addition, the image was recoated on four layers of a beta pattern image, and the attached amount of the ink was set to 200 mg/inch$^2$. The term "beta pattern image" in the present specification means an image in which dots are recorded with respect to an entire pixel as a minimum recording unit area defined by the recording resolution.

In the image of the obtained printed matter, the centers of two sides facing each other were stretched to the opposite directions and the length of the cloth was extended by 1.5 times. Subsequently, the generation condition of cracks of the image was verified by visually observing the image surface. The evaluation criteria are as follows and the evaluation results are listed in Table 3.

A: cracks were not generated

B: cracks were slightly generated

C: cracks were significantly generated

TABLE 3

| | Reference Example 1 | Reference Example 2 | Reference Example 3 |
|---|---|---|---|
| Used ink | Ink of Example 1 | Ink of Example 10 | Ink of Example 11 |
| Results of tension test | A | B | C |

4.2.5. Evaluation of Ink Jet Textile Printing Apparatus

It was examined whether the volume of the pressure chamber of the valve unit and the area of the filter member affected the generation of aggregates of the ink. Specifically, the generation state of the filter aggregates was verified using an ink jet recording apparatus combining the unit and the ink described in Reference Examples 4 to 8 of Table 4. Further, the discharging stability of the ink associated with the generation of aggregates was verified together.

Specifically, the ink jet recording apparatus ("Epson MJ-3000C" (trade name), manufactured by Seiko Epson Corp.) was remodeled such that the volume of the pressure chamber of the valve unit and the area of the filter member had the values listed in Table 4. More specifically, the filter was replaced such that the valve unit had the volume of each pressure chamber and the filter member had the area of each filter member. In addition, the ink cartridges of each of the remodeled printers were filled with the inks of Example 3, the evaluation was performed in the same manner as that of the filter aggregates and the discharging stability. The evaluation results thereof are listed in Table 4.

TABLE 4

| | | Reference Example 4 | Reference Example 5 | Reference Example 6 | Reference Example 7 | Reference Example 8 |
|---|---|---|---|---|---|---|
| Used ink | | Ink of Example 3 | Ink of Example 3 | Ink of Example 3 | Ink of Example 3 | Ink of Example 3 |
| Area of pressure chamber in valve unit | | 2000 | 3000 | 6000 | 2000 | 2000 |
| Area of filter member in filter unit | | 80 | 80 | 80 | 120 | 150 |
| Evaluation test | Filter aggregates | ⊙ | ○ | Δ | ○ | Δ |
| | Discharging stability | ⊙ | ○ | Δ | ○ | Δ |

4.2.6. Evaluation Results

According to the evaluation results in Table 1, since all the inks according to Examples included the 2-pyrrolidone-based solvent and the pH thereof was in the range of 9.2 to 10.5, the generation of aggregates at the gas-liquid interface was suppressed and the storage stability was excellent.

On the other hand, since the ink according to Comparative Example 1 did not include the 2-pyrrolidone-based solvent, the generation of aggregates at the gas-liquid interface was not suppressed.

Further, in all the inks according to Comparative Examples 2 to 4, since the pH thereof was less than 9.2, the generation of aggregates could not be suppressed.

Furthermore, in the ink according to Comparative Example 5, since the pH exceeded 10.5, the storage stability thereof was degraded.

The invention is not limited to the above-described embodiments and various modifications are possible. For example, the invention includes substantially the same configuration (for example, a configuration in which functions, methods, and results are the same or a configuration in which the purposes or effects are the same) as the configuration described in the embodiments. Further, the invention includes a configuration in which a part which is not substantial in the configuration described in the embodiments is replaced. Furthermore, the invention includes a configuration exerting the same operational effects as those of the configuration described in the embodiments or a configuration capable of implementing the same purposes as those of the configuration described in the embodiments. In addition, the invention includes a configuration made by adding a known technology to the configuration described in the embodiments.

The entire disclosure of Japanese Patent Application No.: 2013-016569, filed Jan. 31, 2013 is expressly incorporated by reference herein.

What is claimed is:

1. An ink for ink jet textile printing which is used for recording on cloth, comprising:

a pigment;

a resin; and a 2-pyrrolidone-based solvent, wherein the pH thereof is in the range of 9.2 to 10.5.

2. The ink for ink jet textile printing according to claim 1, wherein coating elongation of the resin is in the range of 400% to 1200%.

3. The ink for ink jet textile printing according to claim 1, wherein the resin contains at least one kind selected from a urethane-based resin and an acrylic resin.

4. The ink for ink jet textile printing according to claim 1, wherein the resin is a self-emulsifying dispersion.

5. The ink for ink jet textile printing according to claim 1, wherein the content of the 2-pyrrolidone-based solvent is in the range of 1% by mass to 8% by mass.

6. The ink for ink jet textile printing according to claim 1, further comprising an inorganic base.

7. A textile printing method using the ink for ink jet textile printing according to claim 1, comprising: forming an image by attaching liquid droplets of the ink to an area of the cloth to which a coagulant which reacts with a component contained in the ink is applied.

8. A textile printing method using the ink for ink jet textile printing according to claim 2, comprising: forming an image by attaching liquid droplets of the ink to an area of the cloth to which a coagulant which reacts with a component contained in the ink is applied.

9. A textile printing method using the ink for ink jet textile printing according to claim 3, comprising: forming an image by attaching liquid droplets of the ink to an area of the cloth to which a coagulant which reacts with a component contained in the ink is applied.

10. A textile printing method using the ink for ink jet textile printing according to claim 4, comprising: forming an image by attaching liquid droplets of the ink to an area of the cloth to which a coagulant which reacts with a component contained in the ink is applied.

11. A textile printing method using the ink for ink jet textile printing according to claim 5, comprising: forming an image by attaching liquid droplets of the ink to an area of the cloth to which a coagulant which reacts with a component contained in the ink is applied.

12. A textile printing method using the ink for ink jet textile printing according to claim 6, comprising: forming an image by attaching liquid droplets of the ink to an area of the cloth to which a coagulant which reacts with a component contained in the ink is applied.

13. An ink jet textile printing apparatus, comprising:

a head which includes a supply channel through which the ink for ink jet textile printing according to claim 1 flows and a nozzle which is connected to the supply channel and discharges the ink; and at least one of a valve unit which is connected to the head and restricts the flow of the ink to be supplied to the head and a filter unit which is provided in the supply channel of the head.

14. An ink jet textile printing apparatus, comprising: a head which includes a supply channel through which the ink for ink jet textile printing according to claim 2 flows and a nozzle which is connected to the supply channel and discharges the ink; and at least one of a valve unit which is connected to the head and restricts the flow of the ink to be supplied to the head and a filter unit which is provided in the supply channel of the head.

15. An ink jet textile printing apparatus, comprising:

a head which includes a supply channel through which the ink for ink jet textile printing according to claim 3 flows and a nozzle which is connected to the supply channel and discharges the ink; and at least one of a valve unit which is connected to the head and restricts the flow of the ink to be supplied to the head and a filter unit which is provided in the supply channel of the head.

16. An ink jet textile printing apparatus, comprising:

a head which includes a supply channel through which the ink for ink jet textile printing according to claim 4 flows and a nozzle which is connected to the supply channel and discharges the ink; and at least one of a valve unit which is connected to the head and restricts the flow of the ink to be supplied to the head and a filter unit which is provided in the supply channel of the head.

17. The ink jet textile printing apparatus according to claim 13, wherein the ink supplied to the valve unit is in contact with air.

18. The ink jet textile printing apparatus according to claim 13, wherein the ink supplied to the filter unit is in contact with air.

19. The ink jet textile printing apparatus according to claim 13, wherein the valve unit includes a pressure chamber and an introduction chamber, the introduction chamber stores the ink to be supplied to the pressure chamber, the pressure chamber includes a connection portion which is connected to the introduction chamber through a pressure adjusting valve restricting the outflow of the ink from the introduction chamber and a connection portion which is connected to the supply channel of the head, and the volume of the pressure chamber is in the range of 400 $mm^3$ to $5000^3$.

20. The ink jet textile printing apparatus according to claim 13, wherein the filter unit includes a filter member, and the area of the filter member is in the range of 7 $mm^2$ to 120 $mm^2$.

21. The ink for ink jet textile printing according to claim 1, wherein the content of the resin is in the range of 1% by mass to 30% by mass based on the total mass of the ink.

22. The ink for ink jet textile printing according to claim 1, wherein the resin is an emulsion.

* * * * *